US007856891B2

(12) United States Patent
Kirst et al.

(10) Patent No.: US 7,856,891 B2
(45) Date of Patent: Dec. 28, 2010

(54) METHOD FOR OPERATING A MEASURING DEVICE ARRANGED ON A ROTATING, CAROUSEL-TYPE, FILLING MACHINE

(75) Inventors: Michael Kirst, Lörrach (DE); Jörg Herwig, Kandern (DE)

(73) Assignee: Endress + Hauser Flowtec AG, Reinach (CH)

( * ) Notice: Subject to any disclaimer, the term of this patent is extended or adjusted under 35 U.S.C. 154(b) by 47 days.

(21) Appl. No.: 12/382,883

(22) Filed: Mar. 26, 2009

(65) Prior Publication Data

US 2009/0249890 A1 Oct. 8, 2009

Related U.S. Application Data

(60) Provisional application No. 61/064,806, filed on Mar. 27, 2008.

(30) Foreign Application Priority Data

Mar. 27, 2008 (DE) ..... 10 2008 016 235

(51) Int. Cl.
*G01F 1/84* (2006.01)

(52) U.S. Cl. ..... 73/861.355

(58) Field of Classification Search .....
73/861.355–861.357
See application file for complete search history.

(56) References Cited

U.S. PATENT DOCUMENTS 5,996,650 A 12/1999 Phallen
6,457,372 B1 10/2002 Laursen
2007/0119121 A1 5/2007 Woods

FOREIGN PATENT DOCUMENTS

| | | |
|---|---|---|
| DE | 102 55 743 | 6/2004 |
| DE | 10 2006 044 592 | 3/2008 |
| DE | 10 2006 062 600 | 7/2008 |
| FR | 2 750 689 A1 | 1/1998 |
| WO | WO 2005/031285 A1 | 4/2005 |
| WO | WO 2007/048742 A1 | 5/2007 |

*Primary Examiner*—Jewel Thompson
(74) *Attorney, Agent, or Firm*—Bacon & Thomas, PLLC

(57) ABSTRACT

A method including: at least one oscillation measurement signal serving as primary signal of first class representing vibrations of a measuring tube, through which medium to be measured is momentarily flowing; and at least one oscillation measurement signal serving as primary signal of second class representing vibrations of at least one measuring tube, especially of the same measuring transducer, and orbiting around the axis of rotation of a carousel-type filling machine orbiting, but not containing flowing medium. Furthermore, based on both the primary signal of first class as well as also the primary signal of second class, at least one measured value, representing a measured variable, especially a mass flow rate and/or an integrated mass flow and/or a density of medium to be measured, is generated. Additionally, an apparatus is provided suited for reducing the method to practice and/or embodied as a carousel-type filling machine.

40 Claims, 2 Drawing Sheets

METHOD FOR OPERATING A MEASURING DEVICE ARRANGED ON A ROTATING, CAROUSEL-TYPE, FILLING MACHINE

FIELD OF THE INVENTION

The invention relates to a method for operating a measuring device arranged on a rotating, carousel-type, filling machine, for example, a measuring device serving for determining mass flow of a flowing medium and/or in the form of a Coriolis, mass flow measuring device, wherein the measuring device includes a measuring transducer of vibration-type, through which medium flows, at least at times. Additionally, the invention relates to an apparatus suitable for reducing the method to practice and/or embodied as a carousel-type, filling machine.

BACKGROUND OF THE INVENTION

Applied in industrial measurements- and automation-technology for automated filling of flowable media, for example, liquids or pastes, into containers, are, besides line fillers, especially, also carousel-type, filling machines (so-called round or rotary-fillers), such as are disclosed, for example, in CA-A 2,023,652, EP-A 893 396, EP-A 405 402, U.S. Pat. No. 7,114,535, U.S. Pat. No. 6,474,368, U.S. Pat. No. 6,026,867, U.S. Pat. No. 5,975,159, U.S. Pat. No. 5,865,225, U.S. Pat. No. 4,588,001, U.S. Pat. No. 4,532,968, U.S. Pat. No. 4,522,238, U.S. Pat. No. 4,053,003, U.S. Pat. No. 3,826,293, U.S. Pat. No. 3,519,108, US-A 2006/0146689, US-A 2003/0037514 or WO-A 04/049641. In such carousel-type, filling machines, the containers, for example, bottles, ampoules, glasses, cans or the like, to be filled with a charge of a medium, such as a solvent, a lacquer or paint, a cleaning agent, a drink, a medicine or the like, are supplied to the rotary filler one after the other via an appropriate feed system. The actual filling procedure is accomplished during a time span in which the container of interest is located within a dispensing station installed on the rotary filler below a filling tip dispensing the medium. After being filled with an, as much as possible, highly precisely dosed charge of medium, the containers leave the rotary filler and are automatically conveyed further. Typical throughput rates of such carousel-type, filling machines can lie quite easily in the order of magnitude of 20,000 containers per hour, wherein the actual filling step and, associated therewith, the actual measuring phase, in which medium to be measured flows through the measuring transducer, is set from a few seconds to less than a second. Preceding this measuring phase, and, accordingly, also, subsequently, a ready-phase of the measuring transducer exists, in which no medium flows through the measuring transducer, i.e. no medium is dosed.

For precise ascertainment of volume of medium actually dosed in each case, often installed in such rotary fillers are in-line measuring devices, which ascertain, highly accurately and in real-time, the charge dosed during the corresponding filling phase, such being accomplished by means of directly measured and internally integrated flow rates of the medium allowed to flow therefor through a measuring transducer of the measuring device serving for the physical-to-electrical transducing of the measured variable to be registered, and so enabling a correspondingly fast and exact control of the filling process. Because of their very high accuracy of measurement, even in the case of comparatively strongly fluctuating flow rates, as well as also comparatively good reproducibility of the measured values delivered under such conditions, in spite thereof, very near in time, such as detailed, for example, also in the Durchflulβ-Handbuch (Flow Handbook), 4th Edition, 2003, ISBN 3-9520220-3-9, in the section "Abfüll- und Dosieranwendungen" ("Filling and Dosing Applications"), page 213 ff., U.S. Pat. No. 5,975,747, or the not pre-published, international patent application PCT/EP2007/059139, especially Coriolis, mass flow measuring devices with measuring transducers of vibration-type are employed, or such as detailed, for example, also in the mentioned Flow Handbook, 4th Edition 2003, ISBN 3-9520220-3-9, in the section "Filling and Metering Applications", page 213 ff., magneto-inductive flow measuring devices are used.

Construction and operation of such flow rate measuring, in-line measuring devices, for example, comprising a measuring transducer of vibration-type or with a measuring transducer of the magneto-inductive type, are known, per se, to those skilled in the art. In-line measuring devices with a measuring transducer of the magneto-inductive type are, moreover, sufficiently described e.g. in EP-A 1 039 269, U.S. Pat. No. 6,031,740, U.S. Pat. No. 5,540,103, U.S. Pat. No. 5,351,554, or U.S. Pat. No. 4,563,904, while in-line measuring devices, especially in-line measuring devices constructed as Coriolis, mass flow measuring devices, with a measuring transducer of vibration-type are described at length and in detail in, among others, WO-A 03/095950, WO-A 03/095949, WO-A 02/37063, WO-A 01/33174, WO-A 00/57141, WO-A 99/39164, WO-A 98/07009, WO-A 95/16897, WO-A 88/03261, US-A 2005/0139015, US 2003/0208325, U.S. Pat. No. 7,181,982, U.S. Pat. No. 7,040,181, U.S. Pat. No. 6,910,366, U.S. Pat. No. 6,895,826, U.S. Pat. No. 6,880,410, U.S. Pat. No. 6,691,583, U.S. Pat. No. 6,651,513, U.S. Pat. No. 6,513,393, U.S. Pat. No. 6,505,519, U.S. Pat. No. 6,041,665, U.S. Pat. No. 6,006,609, U.S. Pat. No. 5,869,770, U.S. Pat. No. 5,861,561, U.S. Pat. No. 5,796,011, U.S. Pat. No. 5,616,868, U.S. Pat. No. 5,602,346, U.S. Pat. No. 5,602,345, U.S. Pat. No. 5,531,126, U.S. Pat. No. 5,359,881, U.S. Pat. No. 5,301,557, U.S. Pat. No. 5,253,533, U.S. Pat. No. 5,218,873, U.S. Pat. No. 5,069,074, U.S. Pat. No. 4,957,005, U.S. Pat. No. 4,895,031, U.S. Pat. No. 4,876,898, U.S. Pat. No. 4,733,569, U.S. Pat. No. 4,660,421, U.S. Pat. No. 4,491,025 or U.S. Pat. No. 4,187,721.

For conveying of the flowing medium, the measuring transducers include, in each case, at least one measuring tube, which is held in a support frame, formed, most often, as a closed, transducer housing, and which includes a bent and/or straight, tube segment. In the case of measuring transducers of vibration-type, this tube segment is excited during operation by means of an electromechanical exciter mechanism, such that it executes oscillations, in order to produce reaction forces correspondingly representative of the measured variable, for example, mass flow rate. For registering, especially inlet-side and outlet-side, vibrations of the tube segment, measuring transducers of vibration-type have, additionally, a sensor arrangement reacting to movements of the tube segment.

In the case of Coriolis, mass flow measuring devices measuring mass flow rates, for example, the measuring of the mass flow, or mass flow rate, of a medium flowing in a pipeline rests, as is known, on the fact that, when the medium to be measured is allowed to flow through at least one measuring tube inserted in a pipeline and oscillating during operation at least partially laterally to a measuring tube axis, Coriolis forces are induced in the medium. This, in turn, effects, that inlet-side and outlet-side regions of the measuring tube oscillate phase-shifted relative to one another. The size of this phase shift serves, in such case, as a measure of the mass flow. The oscillations of the measuring tube are, therefore, registered by means of two oscillation sensors of the aforementioned sensor arrangement spaced from one another along the measuring tube. They convert the oscillations into oscillation measurement signals serving as primary signals of the measuring transducer, from whose phase shift relative to one another, the mass flow is derived. Already the initially referenced U.S. Pat. No. 4,187,721 mentions, additionally, that, by means of such in-line measuring devices, also the instantaneous density of the flowing medium can be measured, and, indeed, on the basis of an instantaneous and/or average frequency of at least one of the oscillation measurement signals delivered by the sensor arrangement. Moreover, most often, also a temperature of the medium is directly measured, in suitable manner, for example, by means of a temperature sensor arranged on the at least one measuring tube. Additionally, straight measuring tubes, excited to torsional oscillations about a torsion oscillation axis essentially extending parallel to, or coinciding with, the particular measuring tube longitudinal axis, effect, that radial shear forces are produced in the medium guided therethrough, whereby, in turn, significant oscillatory energy is withdrawn from the torsional oscillations and dissipated in the medium. Resulting therefrom is a considerable damping of the torsional oscillations of the oscillating measuring tube, so that, to maintain them, the measuring tube must be supplied with additional electrical excitation power. Based on the electrical excitation power correspondingly required for maintaining the torsional oscillations of the measuring tube, it is possible, in manner known to those skilled in the art, to ascertain, by means of the measuring transducer, then, for example, also a viscosity of the medium, at least approximately; compare, in this connection, especially also U.S. Pat. No. 4,524,610, U.S. Pat. No. 5,253,533, U.S. Pat. No. 6,006,609 or U.S. Pat. No. 6,651,513. It can, as a result, be assumed in the following, without further consideration, that—even when not expressly described—modern in-line measuring devices comprising a measuring transducer of vibration-type, especially also Coriolis, mass flow measuring devices, can, in any event, also measure density, viscosity and/or temperature of the medium, the more so, since these parameters are often taken into consideration in the case of the mass flow measurement, for compensation of measurement errors as a result of fluctuating density of the medium and/or viscosity of the medium; compare, in this connection, especially the already mentioned U.S. Pat. No. 6,513,393, U.S. Pat. No. 6,006,609, U.S. Pat. No. 5,602,346, WO-A 02/37063, WO-A 99/39164 or also WO-A 00/36379.

The measuring transducer, which is usually provided in the form of a self-sufficient, conventional, in-line measuring device in compact construction (thus with, accommodated in a corresponding electronics-housing, an internal, measuring transducer electronics enabling the measuring operation and communication with superordinated operating units, such as a process control system), is appropriately connected via, respectively, inlet-side and outlet-side, most often, standardized connection elements, for example, screwed connections or flanges, to, respectively, medium-to-be-measured supplying and measured-medium removing, line segments of the pipeline system of the filling system conveying the medium during operation. In case required, besides the usually rigidly formed line segments, additionally, supplemental holding apparatuses serve for affixing the measuring device within the rotary filler. Usually, the measuring transducers are, in such case, so arranged within the rotary filler, that the flow axis connecting both of the connection elements of the measuring transducer and the axis of rotation of the rotary filler itself extend at an angle of less than 90°, or essentially parallel, relative to one another.

The measuring device electronics of conventional in-line measuring devices of the kind being discussed include, most often, a microcomputer delivering digital, measured values in real-time, along with corresponding volatile and non-volatile data memories for storing (on occasion, also for a retentive logging), also, of required digital measurement- or operating-data, such as the current angular velocity, with which the rotary filler is operating and with which, thus, the measuring transducer is orbiting, or revolving, around the axis of rotation, internally ascertained and/or externally transmitted to the pertinent in-line measuring device, for the safe proceeding of the filling process.

In the case of the application, in rotary fillers, of flow measuring, in-line measuring devices of the kind being discussed, especially mass flow rate and/or integrated mass flow measuring, Coriolis, mass flow measuring devices, it has, however, been found, that the accuracy of measurement, with which flow, or flow rate, is, in each case, ascertained, can be subject to quite considerable fluctuations, in spite of flow conditions lying within predetermined specifications and media properties, such as, for instance, density and viscosity of the medium being sufficiently known or also largely held constant. Moreover, the accuracy of measurement can lie, possibly, also outside of a tolerance range acceptable for such filling- or dosing-applications.

A possible cause for such measuring inaccuracies of flow measuring, in-line, measuring devices can, as discussed in, among others, also the initially mentioned U.S. Pat. No. 7,181,982, U.S. Pat. No. 7,040,181, U.S. Pat. No. 6,910,366, U.S. Pat. No. 6,880,410, U.S. Pat. No. 6,505,519, U.S. Pat. No. 6,311,136 or U.S. Pat. No. 5,400,657, lie, for example, in the fact that the medium to be measured can be composed, for process reasons, of two or more phases, for example, as with gas- and/or solids-bearing liquid, wherein the solids can be granular material or powder. Besides such disturbing influences as a result of inhomogeneities in the medium to be dosed, such as, for instance a liquid bearing entrained gas bubbles and/or entrained solid particles, additionally, for example, asymmetries in the flow profile brought about by pronounced curvatures of the measuring tubes and/or turbulence in the flowing medium can lead to fluctuations in accuracy of measurement; compare, in this connection, also the initially mentioned U.S. Pat. No. 6,513,393.

Further investigations have additionally shown, that such fluctuations are not attributable alone to the aforementioned inhomogeneities per se, but, instead, can further depend, in considerable measure, also on the instantaneous orbiting or rotational movement of the measuring transducer or on changes of the RPM (revolutions per minute) of the rotary filler. This cross-sensitivity of flow measuring, in-line measuring devices to angular and/or orbital velocity around the axis of rotation of the rotary filler, or its RPM, can, for example, be related to the fact that, accompanying the orbital movement of the affected measuring transducer, acceleration forces, compared to a resting measuring transducer in otherwise comparable measuring situation, unavoidably acting on the measuring transducer and, thus, also on the therein conveyed medium, can effect a small deformation of the flow- and/or density-profile, this, especially, also in the aforementioned case of a medium composed of two or more phases. Unfortunately, the accuracy of measurement degraded under the aforementioned circumstances shows up, in special measure, due to a resultantly variable zero point of the affected measuring device, thus in such a way, that the measured value, for example, the instantaneous mass flow rate or the integrated mass flow delivered by the measuring transducer electronics also has a deviation dependent on RPM.

Especially, it has been found in the case of measuring transducers of vibration-type, additionally, that the above-mentioned measurement errors, such as can arise, at times, in the case of conventional flow measurements in rotary fillers, such as, for instance, the determining of the integrated mass flow, are, additionally, also attributable to the fact that the oscillation sensors serving for registering the oscillatory movement of the at least one measuring tube register an additional oscillatory movement caused by the rotational movement of the measuring transducer around the axis of rotation of the round filler; compare, in this connection, also the initially mentioned international patent application PCT/EP2007/059139.

As a result of such disturbances partially significantly degrading the actual flow measurement, the primary measurement signals, such as are delivered by measuring transducers installed on rotary fillers, such as, for instance, the oscillation measurement signals of Coriolis, mass flow measuring devices, for a highly exact measuring of the respective physical flow parameters, cannot be used, without further corrective measures also taking into consideration the rotational movement, this being true the more so since such in-line measuring devices can be exposed, process dependently, at the same time also to two- or multi-phase flows of medium. This, in turn, makes it necessary to take into consideration, in suitable manner, when measuring flow, parameters, such as acceleration forces and RPM changes, or parameters derived therefrom, disturbingly influencing the accuracy of measurement.

SUMMARY OF THE INVENTION

In consideration of the fact that, on the one hand, in the case of in-line measuring devices, especially also Coriolis, mass flow measuring devices, installed on rotary fillers, the acceleration forces resulting from the rotations, such as, for instance, the centrifugal forces and/or the acceleration forces associated with changes of RPM, can effect a certain RPM dependence of the accuracy of measurement, especially also the zero point, while, on the other hand, robust, sufficiently well repeatable, as well as also highly exact measuring is required in the filling procedures, especially also in filling procedures accomplished by means of rotary fillers, it is an object of the invention, therefore, to improve measuring systems of the initially mentioned kind utilizing in-line measuring devices rotating, during operation, about an axis of rotation, such that a more exact measuring of the measured variables to be ascertained for the filling, especially the mass flow rates and/or integrated mass flows, is enabled, especially also in the case of two- or multi-phase media and/or variable RPM of the pertinent rotary filler, and, therewith, an exact dosing can be assured.

For achieving the object, the invention resides in a method for operating a measuring device arranged on a rotating, carousel-type, filling machine and including a measuring transducer of vibration-type, through which a medium flows, at least at times, especially a measuring device serving for determining mass flow of a flowing medium and/or formed as a Coriolis, mass flow measuring device, which method includes steps as follows:

permitting flow of medium to be measured through at least one, at least momentarily vibrating, measuring transducer measuring tube orbiting around an axis of rotation of the carousel-type filling machine;

producing at least one oscillation measurement signal serving as primary signal of first class and representing vibrations of the measuring tube as medium to be measured is flowing therethrough;

producing at least one oscillation measurement signal serving as primary signal of second class and representing vibrations of at least one measuring tube, through which medium is not flowing, which is orbiting around the axis of rotation of the carousel-type filling machine, and which is, preferably, a measuring tube of said measuring transducer; and ascertaining at least one measured value representing a measured variable, especially a mass flow rate and/or an integrated mass flow and/or a density, of the medium to be measured, based on both the primary signal of first class as well as also the primary signal of second class.

Moreover, the invention resides in an apparatus, especially an apparatus suited for reducing the method to practice and/or embodied as a carousel-type filling machine, which apparatus includes:

at least a first measuring transducer, which has at least one measuring tube, through which medium to be measured, especially at least partially, or predominantly, liquid medium, flows only at times, which is moved during operation about an axis of rotation, especially in circular orbit and/or with an angular velocity held essentially constant, and which, at least at times, delivers primary signals, which correspond to at least one measured variable of the medium guided in the at least one measuring tube; as well as at least one measuring transducer electronics for producing measured values, especially digital, measured values;

wherein medium to be measured flows through the at least one measuring tube during a measuring phase, especially a periodically reoccurring measuring phase, of the first measuring transducer, and wherein the at least one measuring transducer electronics ascertains, at least at times, especially reoccurringly, a measured value representing the at least one measured variable, especially a flow rate in the measuring transducer through which medium to be measured is flowing and/or an integrated flow, based both on at least one primary signal of first class delivered by the first measuring transducer during the measuring phase, as well as also based on at least one primary signal of second class, which is generated by means of a measuring tube likewise moved around the axis of rotation, but through which, at times of generating said primary signal of second class, the medium does not flow.

In a first embodiment of the method of the invention, such further includes a step of ascertaining a correction value for the primary signal of first class based on the primary signal of second class.

In a second embodiment of the method of the invention, it is provided, that the correction value is correlated with an instantaneous angular velocity, with which the at least one measuring transducer measuring tube, through which medium is flowing, is moved around the axis of rotation of the carousel-type filling machine, and/or the correction value represents an influence of the movement of the at least one measuring transducer measuring tube around the axis of rotation on primary signals, especially the at least one primary signal of first class, delivered by the measuring transducer.

In a third embodiment of the method of the invention, such further includes a step of ascertaining an angular velocity, with which the at least one measuring transducer measuring tube, through which medium is flowing, is moved around the axis of rotation of the carousel-type filling machine. Developing this embodiment of the method further, it is additionally provided, that the at least one measured value is ascertained taking into consideration the angular velocity.

In a fourth embodiment of the method of the invention, it is provided, that the medium to be measured is, at times, prevented from flowing through the at least one measuring transducer measuring tube.

In a fifth embodiment of the method of the invention, such further includes a step of using the measuring transducer, while such is vibrating, but medium to be measured is not flowing therethrough, for producing also the at least one primary signal of second class.

In a sixth embodiment of the method of the invention, such further includes a step of filling a containment on the outlet side of the measuring transducer with medium allowed to flow through the at least one measuring tube.

In a seventh embodiment of the method of the invention, such further includes a step of using at least one additional measuring transducer, likewise orbiting around the axis of rotation of the carousel-type filling machine, and including at least one momentarily vibrating measuring tube, through which, however, medium to be measured is not flowing, especially a measuring tube of essentially equal construction to that momentarily containing flowing medium to be measured, for producing the at least one primary signal of second class.

In a first embodiment of the apparatus of the invention, it is provided, that the measuring transducer electronics ascertains, based at least on the primary signal of second class, especially reoccurringly, at least one correction value for the primary signal of first class. Developing this embodiment of the invention further, it is additionally provided, that the at least one measuring transducer electronics ascertains the correction value based also on the primary signal of first class delivered by the first measuring transducer, especially instantaneously and/or during its measuring phase.

In a second embodiment of the apparatus of the invention, it is provided, that the measuring transducer electronics ascertains the measured value under application of both the primary signal of first class delivered by the first measuring transducer during its measuring phase as well as also under application of the correction value.

In a third embodiment of the apparatus of the invention, it is provided, that the correction value delivered by the measuring transducer electronics corresponds to a measured, especially instantaneous or average, flow rate, especially a mass flow rate or a volume flow rate, which represents medium seemingly flowing through the measuring transducer in the ready phase.

In a fourth embodiment of the apparatus of the invention, it is provided, that the correction value delivered by the measuring transducer electronics correlates with an instantaneous angular velocity, with which the at least one measuring tube of the first measuring transducer is moved around the axis of rotation, and/or the correction value instantaneously represents an influence of the movement of the at least one measuring tube of the first measuring transducer around the axis of rotation on primary signals delivered by the measuring transducer, especially the primary signal of first class delivered during the measuring phase.

In a fifth embodiment of the apparatus of the invention, it is provided, that the at least one correction value is ascertained, before the measuring phase of the first measuring transducer begins.

In a sixth embodiment of the apparatus of the invention, it is provided, that the at least one measuring transducer electronics stores the at least one correction value, at least at times, especially in a volatile data memory.

In a seventh embodiment of the apparatus of the invention, it is provided, that the at least one measured value delivered by the measuring transducer electronics represents a mass flow rate, especially an instantaneous or integrated mass flow rate, of medium actually flowing through the first measuring transducer in the measuring phase.

In an eighth embodiment of the apparatus of the invention, it is provided, that the measuring transducer electronics, during operation, holds ready, at least at times, an RPM value, especially a reoccurringly ascertained and/or updated RPM value, which represents, instantaneously, an angular velocity, especially a current angular velocity, with which the at least one measuring tube orbits around the axis of rotation.

In a ninth embodiment of the apparatus of the invention, it is provided, that the first measuring transducer is connected via an inlet-side, first connection element, especially a screwed connection or a flange, to a line segment of a pipeline system supplying medium to be measured. Developing this embodiment of the invention further, it is additionally provided that the first measuring transducer is connected via an outlet-side, second connection element, especially a screwed connection or a flange, to a line segment of the pipeline system removing, or draining, measured medium. Accordingly, the first measuring transducer shows a flow axis connecting the two connection elements, wherein the first measuring transducer is so arranged within the apparatus, that its flow axis and the axis of rotation form an angle of less than 90°, or that the flow axis of the first measuring transducer is essentially parallel to the axis of rotation.

In a tenth embodiment of the apparatus of the invention, it is provided, that the at least one measuring tube, especially a tube segment thereof caused to vibrate during operation, is at least sectionally essentially straight.

In an eleventh embodiment of the apparatus of the invention, it is provided, that the at least one measuring tube, especially a tube segment thereof caused to vibrate during operation, is at least sectionally curved.

In a twelfth embodiment of the apparatus of the invention, it is provided, that the at least one measuring transducer electronics is arranged in the immediate vicinity of the first measuring transducer and/or essentially rigidly connected therewith.

In a thirteenth embodiment of the apparatus of the invention, it is provided, that each of the measuring transducers shows a measuring transducer housing, which houses the at least one measuring tube.

In a fourteenth embodiment of the apparatus of the invention, it is provided, that the at least one measuring transducer electronics is accommodated in an associated electronics-housing. Developing this embodiment of the invention further, it is additionally provided, that the electronics-housing is mounted, especially essentially rigidly, on the measuring transducer housing of the first measuring transducer.

In a fifteenth embodiment of the apparatus of the invention, it is provided, that the apparatus further includes a control electronics for setting and monitoring an angular velocity, with which the at least one measuring tube of the first measuring transducer is moved around the axis of rotation. Developing this embodiment of the invention further, it is additionally provided, that the measuring transducer electronics and the control electronics communicate with one another, at least at times, during operation, especially wirelessly via radio. Alternatively thereto, or in supplementation thereof, the measuring transducer electronics can, during operation, at least at times, especially reoccurringly, transmit measured data, especially a measured value and/or a correction value for the primary signal of first class, to the control electronics, and/or the measuring transducer electronics can, during operation, at least at times, especially reoccurringly, receive control data generated by the control electronics, especially a current angular velocity with which the at least one measuring tube of the first measuring transducer is moved around the axis of rotation.

In a sixteenth embodiment of the apparatus of the invention, it is provided, that the measuring transducer electronics, during operation, at least at times, stores an RPM value, especially a digital RPM value and/or an RPM value generated externally of the measuring transducer electronics, wherein the RPM value represents, instantaneously, an angular velocity, with which the at least one measuring tube of the first measuring transducer is moved around the axis of rotation. Developing this embodiment of the invention further, it is additionally provided, that the measuring transducer electronics ascertains the at least one measured value and/or the correction value for the at least one primary signal of first class, under application of the RPM value.

In a seventeenth embodiment of the apparatus of the invention, it is provided, that the first measuring transducer delivers also the primary signal of second class. Developing this embodiment of the invention further, it is additionally provided, that the first measuring transducer generates the primary signal of second class during an, especially periodically reoccurring, ready phase, in which medium to be measured does not flow through the at least one measuring tube of the first measuring transducer. Alternatively thereto, or in supplementation thereof, it is additionally provided, that the measuring transducer electronics ascertains the at least one measured value based both on the primary signal of first class delivered by the first measuring transducer during its measuring phase as well as also based on the primary signal of second class delivered by the first measuring transducer during its ready phase.

In an eighteenth embodiment of the apparatus of the invention, the first measuring transducer is a measuring transducer of vibration-type, in the case of which measuring transducer the at least one measuring tube is caused to vibrate, at least at times, for producing oscillation measurement signals serving as primary signals.

In a first further development of the eighteenth embodiment of the invention, it is additionally provided, that medium to be measured flows through the at least one measuring tube of the first measuring transducer during its measuring phase and the at least one measuring tube of the first measuring transducer is caused to vibrate for the purpose of generating at least a first oscillation measurement signal serving as primary signal of first class and representing vibrations of the at least one measuring tube. Especially, in such case, the measuring tube, especially that of the first measuring transducer, serving for generating the at least one primary signal of second class, is likewise caused to vibrate and a second oscillation measurement signal representing vibrations of said measuring tube serves as primary signal of second class. Alternatively thereto, or in supplementation thereof, the at least one measuring transducer electronics, based on the primary signal of first class delivered by the first measuring transducer during its measuring phase as well as based on the primary signal of second class, ascertains a difference value, which represents a difference between an oscillation frequency, especially an instantaneous or average oscillation frequency, with which the at least one measuring tube of the first measuring transducer is caused to vibrate during its measuring phase, and an oscillation frequency, especially an average oscillation frequency, with which the at least one measuring tube serving for generating the primary signal of second class is caused to vibrate.

In a second further development of the eighteenth embodiment of the invention, it is additionally provided, that the first measuring transducer delivers, during its measuring phase, a first primary signal of first class, which represents inlet-side vibrations of the at least one measuring tube, and, wherein the first measuring transducer, especially concurrently with the first primary signal, delivers at least one second primary signal of first class, which represents outlet-side vibrations of the at least one measuring tube. Especially, in such case, the at least one measuring transducer electronics ascertains, based on the first and second primary signals of first class delivered by the first measuring transducer during its measuring phase, additionally, a phase difference between inlet-side and outlet-side vibrations of the at least one measuring tube corresponding to a mass flow rate of the medium flowing in the at least one measuring tube. In supplementation thereof, at least one measuring transducer electronics ascertains, additionally, the at least one measured value, based on the phase difference, especially a measured value instantaneously representing mass flow rate of the medium flowing in the at least one measuring tube of the first measuring transducer.

In a third further development of the eighteenth embodiment of the invention, it is additionally provided, that the at least one measuring tube of the first measuring transducer is caused to vibrate also during the ready phase of the first measuring transducer for the purpose of generating of the at least one primary signal of second class. For the case, in which the measuring transducer is a measuring transducer of vibration-type, it is, in such case, additionally provided, that the first measuring transducer delivers, during its ready phase, a first primary signal of second class, which represents inlet-side vibrations of the at least one measuring tube during the ready phase, and that the first measuring transducer delivers, especially concurrently with the first primary signal of second class, at least a second primary signal of second class, which represents outlet-side vibrations of the at least one measuring tube during the ready phase.

In a fourth further development of the eighteenth embodiment of the invention, it is additionally provided, that the at least one measuring transducer electronics ascertains the at least one measured value based on an oscillation frequency corresponding to a density of the medium guided in the at least one measuring tube, especially an instantaneous or average oscillation frequency, with which the at least one measuring tube is caused to vibrate during operation of the first measuring transducer, especially during its measuring phase. Additionally, it is, in such case, provided, that the at least one measuring transducer electronics ascertains, on the basis of the primary signal of first class, the oscillation frequency, with which the at least one measuring tube of the first measuring transducer is caused to vibrate during its measuring phase.

In a fifth further development of the eighteenth embodiment of the invention, it is additionally provided, that the at least one measuring transducer electronics generates the at least one measured value based on an oscillation frequency corresponding to a density of the medium guided in the at least one measuring tube, especially an instantaneous or average oscillation frequency, with which the at least one measuring tube of the first measuring transducer is caused to vibrate during its ready phase. Additionally, it is, in such case, provided, that the at least one measuring transducer electronics ascertains, on the basis of the primary signal of second class, the oscillation frequency, with which the at least one measuring tube of the first measuring transducer is caused to vibrate during its ready phase.

In a nineteenth embodiment of the apparatus of the invention, the first measuring transducer is a measuring transducer of magneto-inductive type, in the case of which measuring transducer, a magnetic field passes through the at least one measuring tube, at least at times, especially during the measuring phase, for producing voltage measurement signals serving as primary signals and voltages induced in the medium are sensed by means of at least two electrodes, especially electrodes galvanically and/or capacitively coupled to the medium.

In a twentieth embodiment of the apparatus of the invention, it is provided, that the apparatus further includes at least a second measuring transducer spaced from the first measuring transducer, especially a second measuring transducer structurally and functionally equal to the first measuring transducer.

In a first further development of the twentieth embodiment of the invention, it is additionally provided, that the second measuring transducer includes at least one measuring tube, through which medium does not, at least at times, flow and which, during operation, is likewise moved around the axis of rotation, and that the second measuring transducer delivers, at least at times, primary signals, which correspond to at least one measured variable of medium guided in its at least one measuring tube.

In a second further development of the twentieth embodiment of the invention, it is additionally provided, that the at least one measuring tube of the second measuring transducer, which measuring tube is moved around the axis of rotation, does not have medium flowing through it during a ready phase, especially a periodically reoccurring ready phase, of the second measuring transducer.

In a third further development of the twentieth embodiment of the invention, it is additionally provided, that the primary signal of second class is generated by the second measuring transducer during its ready phase.

In a fourth further development of the twentieth embodiment of the invention, it is additionally provided, that the measuring transducer electronics ascertains the at least one measured value based both on the primary signal of first class delivered by the first measuring transducer during its measuring phase, as well as also based on the primary signal of second class delivered by the second measuring transducer during its ready phase.

In a fifth further development of the twentieth embodiment of the invention, it is additionally provided, that also the second measuring transducer delivers, during a measuring phase, especially a periodically reoccurring measuring phase, in which medium to be measured flows through the measuring tube, at least one primary signal of first class, which corresponds to a measured variable of the medium flowing in the associated at least one measuring tube.

In a twenty-first embodiment of the apparatus of the invention, it is provided, that the measuring tube of the measuring transducer generating the primary signal of second class is filled during its ready phase at least partially with essentially the same medium, which is allowed to flow in the at least one measuring tube of the measuring transducer generating, during its measuring phase, the primary signal of first class. Developing this embodiment of the invention further, it is additionally provided, that the at least one measuring tube of the measuring transducer generating, during its ready phase, the primary signal of second class is filled only partially with essentially the same medium, which is allowed to flow in the at least one measuring tube of the measuring transducer generating, during its measuring phase, the primary signal of first class.

In a twenty-second embodiment of the apparatus of the invention, it is provided, that the at least one measuring tube of the measuring transducer generating, during its ready phase, the primary signal of second class is filled, at least partially, with another medium, than is allowed to flow in the at least one measuring tube of the measuring transducer generating the primary signal of first class during its measuring phase.

In a twenty-third embodiment of the apparatus of the invention, it is provided, that the at least one measuring tube of the measuring transducer generating, during its ready phase, the primary signal of second class, is filled, especially exclusively or at least predominantly, with gas, especially nitrogen or air.

In a twenty-fourth embodiment of the apparatus of the invention, it is provided, that a starting time, in the case of which the ready phase of the measuring transducer generating the primary signal of second class begins, is placed timewise before a starting time, in the case of which the measuring phase of the measuring transducer generating the primary signal of first class begins.

In a twenty-fifth embodiment of the apparatus of the invention, it is provided, that a stop time, in the case of which the ready phase of the measuring transducer generating the primary signal of second class ends, is placed timewise before a stop time, in the case of which the measuring phase of the measuring transducer generating the primary signal of first class ends. Developing this embodiment of the invention further, it is additionally provided, that the stop time, in the case of which the ready phase of the measuring transducer generating the primary signal of second class ends, is placed timewise before the starting time, in the case of which the measuring phase of the measuring transducer generating the primary signal of first class begins.

In a twenty-sixth embodiment of the apparatus of the invention, it is provided, that the correction value delivered by the measuring transducer electronics corresponds to a measured flow rate, especially an instantaneous or average measured flow rate, especially a mass flow rate or a volume flow rate, which represents medium seemingly flowing in the ready phase through the measuring transducer.

In a twenty-seventh embodiment of the apparatus of the invention, the apparatus further includes at least one valve setting a flow through the at least one measuring transducer measuring tube, especially a valve arranged on the outlet side of the first measuring transducer. Developing this embodiment of the invention further, it is additionally provided, that the at least one valve is controlled by means of the at least one measuring transducer electronics, especially under application of the at least one measured value, and/or that the at least one measuring transducer electronics monitors the at least one valve, especially under application of the at least one primary signal of second class and/or a correction value derived therefrom for the at least one primary signal of first class, especially as regards a closing behavior thereof.

In a twenty-eighth embodiment of the apparatus of the invention, it is provided, that the apparatus includes a plurality of measuring transducers, especially measuring transducers which are structurally and functionally equal to the first measuring transducer, of which each includes at least one measuring tube arranged spaced from the at least one measuring tube of the first measuring transducer, especially along a shared circumference, and, likewise, in each case, moved around the axis of rotation.

In a first further development of the twenty-eighth embodiment of the invention, it is additionally provided, that each of the measuring transducers delivers, at least at times, primary signals, which correspond to at least one measured variable of the medium guided in the at least one, associated measuring tube, and/or that medium to be measured flows through the at least one measuring tube moved around the axis of rotation of each of the measuring transducers during a measuring phase, especially a periodically reoccurring measuring phase, of the associated measuring transducer. In the latter case, additionally, each of the measuring transducers, especially also a plurality of the measuring transducers, can deliver, during its measuring phase, concurrently, primary signals of first class, which, in each case, correspond to the at least one measured variable to be registered for the medium guided in the at least one, associated, measuring tube.

In a second further development of the twenty-eighth embodiment of the invention, it is additionally provided, that medium does not, during a ready phase, especially a periodically reoccurring ready phase, of the associated measuring transducer, flow through the at least one measuring tube of each of the measuring transducers moved around the axis of rotation.

In a third further development of the twenty-eighth embodiment of the invention, it is additionally provided, that a plurality of the measuring transducers deliver, during a respective ready phase, primary signals of second class, which correspond to at least one measured variable of the medium guided in the at least one, associated, measuring tube.

In a fourth further development of the twenty-eighth embodiment of the invention, it is additionally provided, that a plurality of the measuring transducers deliver, concurrently, primary signals of second class.

In a fifth further development of the twenty-eighth embodiment of the invention, it is additionally provided, that each of the measuring transducers includes an associated measuring transducer electronics, especially a measuring transducer electronics accommodated, in each case, in a separate electronics-housing.

In a sixth further development of the twenty-eighth embodiment of the invention, it is additionally provided, that at least two of the measuring transducer electronics communicate with one another during operation, especially wirelessly per radio and/or by hardwire, especially for sending and/or receiving measured values and/or for sending and/or receiving correction values for primary signals produced by means of measuring transducers.

A basic idea of the invention is to ascertain, during ongoing operation of rotary fillers, the actual extent of the disturbing parameters influencing the measuring as a result of the rotational movement of the rotary filler, such as, for instance, RPM-dependent, accelerative forces, on the primary signals of measuring transducers rotating in the above sense, primary signals won during a measuring phase defined by the actual dosing procedure and thus primary signals carrying both the information concerning the measured variable actually to be registered, such as, for instance, mass flow rate and/or integrated mass flow, as well as also information concerning the disturbance, by providing that, additionally, another primary signal generated during a ready phase with the same measuring transducer, and/or with an equally moved, other, however, same-type, especially structurally and functionally equal, measuring transducer, is evaluated or utilized for the actual measuring. In such case, one starts from a realization, that the measuring transducer, dependent on how the process operates, is subjected during the ready phase, indeed, to essentially the same disturbance as during the preceding, and/or next, measuring phase, while, in the ready phase, no medium is flowing through, so that primary signals generated during times of the ready phase represent only the disturbance to be compensated, for example, in the form of a flow rate seemingly suggesting that medium is flowing through the measuring transducer in the ready phase.

Based on two or more such primary signals—generated, respectively, during a measuring phase and during a ready phase of measuring transducers installed on rotary fillers—e.g. the instantaneous zero point of a measuring system formed by means of particular measuring transducer and connected measuring transducer electronics, or a momentary shifting of the zero-point relative to an earlier calibrated, initial-zero point, can, practically directly, be ascertained during ongoing operation of the rotary filler. Furthermore, it is then also possible to ascertain, if conditions require, also reoccurringly, a correction factor during operation, which appropriately compensates disturbing influences, especially RPM-dependent, disturbing influences, affecting accuracy of measurement of in-line measuring devices installed in rotary fillers, and so, if conditions require, also to reference the currently ascertained zero point for the measuring system appropriately back to the initial zero point in the course of a zero-point calibration.

The invention utilizes, in such case, the special circumstance, dependent on the filling process, that, in a phase of the procedure, in which the flow rate—as a result of knowingly closed filling valves and/or as a result of knowingly emptied measuring tubes—equals zero and, as a result, is defined, so that, in the therewith corresponding, ready phase of the measuring transducer, the then generated primary signal, with, in the case of measuring transducers of vibration-type, for example, measuring tube still vibrating, should actually signal no medium to be flowing, so that flow rates ascertained based on this primary signal ought actually to equal zero. Any primary signals or measured values deviating therefrom should correspond, thus, essentially to measuring errors present during the preceding and/or subsequent, actual measuring phase of this or another measuring transducer and can, thus, correspondingly—depending on sign, for example, additively, or subtractively—enter at least into the pertinent next measurement result, for example, in the form of a zero-point calibration automatically performed in the associated measuring transducer electronics.

The zero-point currently registered for the measuring device or its measuring transducer as a result of corresponding measurements during its ready phase can, depending on computing speed of the involved measuring transducer electronics, be applied in one of the next-following measuring phases of the corresponding measuring transducer and, thus, after a zero-point calibration performed correspondingly near in time, be appropriately taken into consideration in the measuring of flow for further dosing, and, if conditions require, also in a corresponding correction of a filling-balance produced over a longer period of time. Alternatively thereto, or in supplementation thereof, the currently ascertained zero-point or measuring errors or a correction factor correspondingly compensating such can be appropriately taken into consideration already for error correction in a subsequent measuring, which is performed in one of the next filling phases of the rotary filler by means of another measuring transducer first transferred from its ready phase into the measuring phase.

In order to improve the reliability of the zero-point of a particular measuring transducer ascertained reoccurringly during operation of the rotary filler, an option is, moreover, appropriately to average individual zero-points and/or zero-point offsets or correction factors appropriately compensating such, as obtained in the above-described manner, over a number of revolutions and/or by means of a plurality of measuring transducers in their ready phases.

Based on comparison of the measured correction factor with nominal reference values correspondingly predetermined therefor and/or based on statistical evaluations of such zero-point offsets and/or correction factors registered over a longer period of time, for example, an empirical scattering of the zero-point about an initially predetermined starting value, then also, further, a monitoring of the rotary filler and/or the therein arranged measuring system formed by means of measuring transducer and corresponding measuring transducer electronics, to be performed during operation, can be enabled. In the case of exceeding of correspondingly predetermined reference values, then, if conditions require, also a corresponding alarm can be triggered for suitably signaling a malfunctioning rotary filler, for example, as a result of a leaking valve and/or a defective measuring transducer, and/or a defective filling process, for example, as a function of properties of the medium differing from corresponding quality specifications. For the case, in which, for example, each of the, in each case, individually ascertained zero-point offsets or correspondingly ascertained correction factors for the aforementioned measuring system exceeds the correspondingly predetermined reference value, it is to be assumed therefrom, that the process, as such, is disturbed, for example, by a medium deviating impermissibly from the quality specifications and/or an error in the carousel-type filling machine. Conversely, a repeated exceeding of a predetermined reference value in the case of only one measuring transducer would rather point to a defective dispensing station, for example, a defective valve and/or a defective measuring system.

BRIEF DESCRIPTION OF THE DRAWINGS

The invention and further advantages will now be explained in greater detail on the basis of examples of embodiments shown in the drawing; equal parts are provided in the figures of the drawing with equal reference characters. In case helpful to avoid clutter, already used reference characters are omitted in subsequent figures. The figures of the drawing show as follows.

DETAILED DESCRIPTION OF EXEMPLARY EMBODIMENTS

Figure 1:
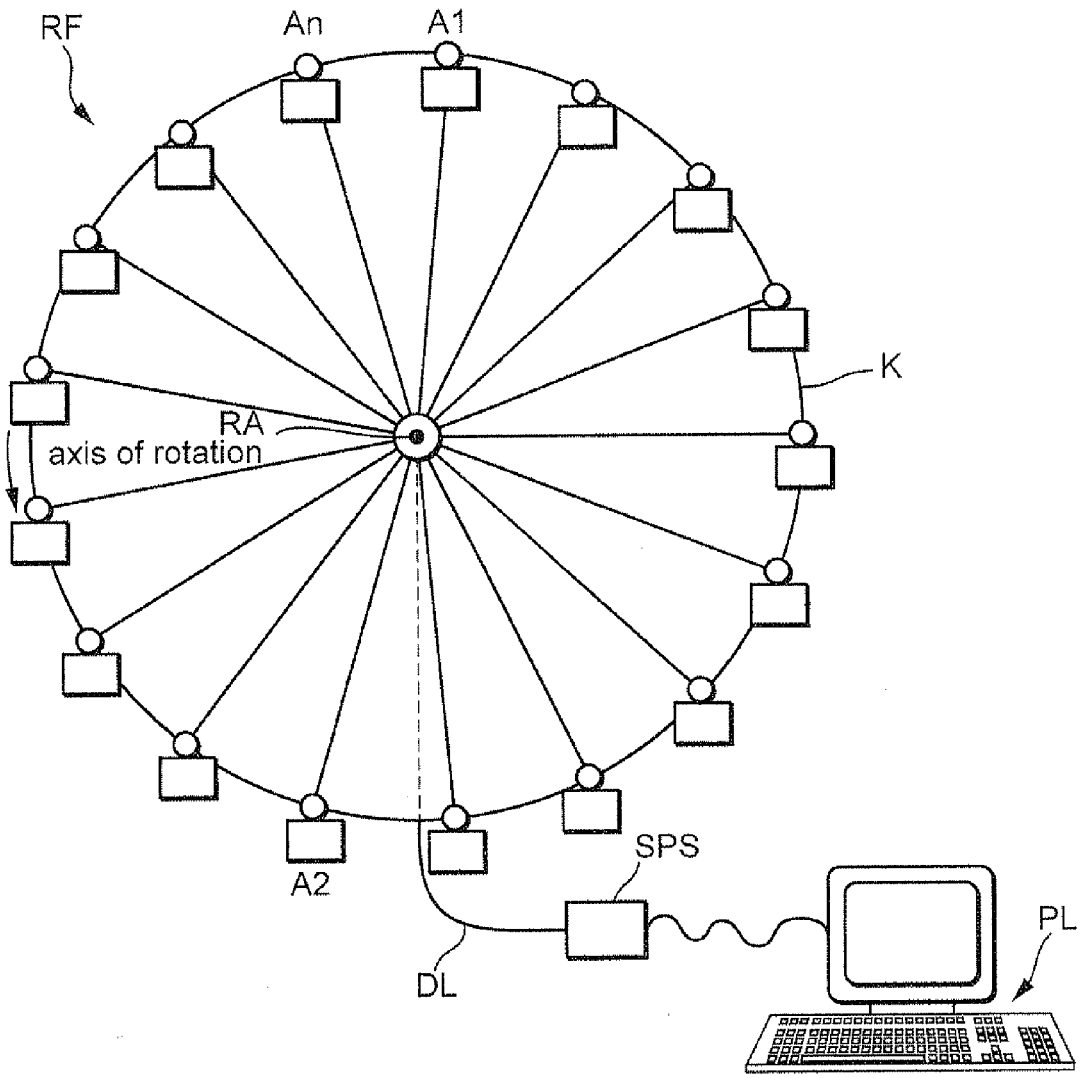
FIG. 1 a schematic, plan view of a carousel-type filling machine.

While the invention is susceptible to various modifications and alternative forms, exemplary embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the intended claims.

FIG. 1 shows schematically a plan view onto a carousel-type filling machine RF serving for the sequential filling of containments, such as, for instance, bottles, cups, ampoules or the like, with, in each case, a defined amount of a medium, especially a medium which is, at least partially or predominantly liquid. The medium can, in such case, be practically any flowable, dosable material, such as a low-viscosity liquid, or a pasty liquid or e.g. even a granular material or powder.

The carousel-type filling machine RF includes a carousel K (here embodied as a rotor), on which are arranged, distributed uniformly along a circumference, a plurality of essentially structurally and functionally equal, especially identical, dispensing stations DS1-DSn. The dispensing stations orbit, during operation of the carousel-type filling machine, in the case of driving of the carousel K about a central axis of rotation RA, on an orbital path correspondingly defined by the carousel K and the arrangement of the corresponding dispensing stations (the path is, thus, here, circular), and, indeed, with an angular velocity held essentially constant, at least over a period of time of a number of revolutions.

The containments to be filled are sequentially transferred in suitable manner to the carousel K and to the, in each case, assigned dispensing station via a supply system, for example, formed by means of a conveyor belt and a so-called infeed star. Each containment is filled during a filling phase marking the actual filling procedure at each dispensing station, during which medium is allowed to flow into the intended containment, until a pre-defined amount of filling is reached. Following termination of its filling phase, each of the containments is taken by a removal system, formed, for example, by means of a so-called ouffeed star and a removal belt, possibly also already suitably sealed, and transferred to the next station for additional handling.

Figure 2:
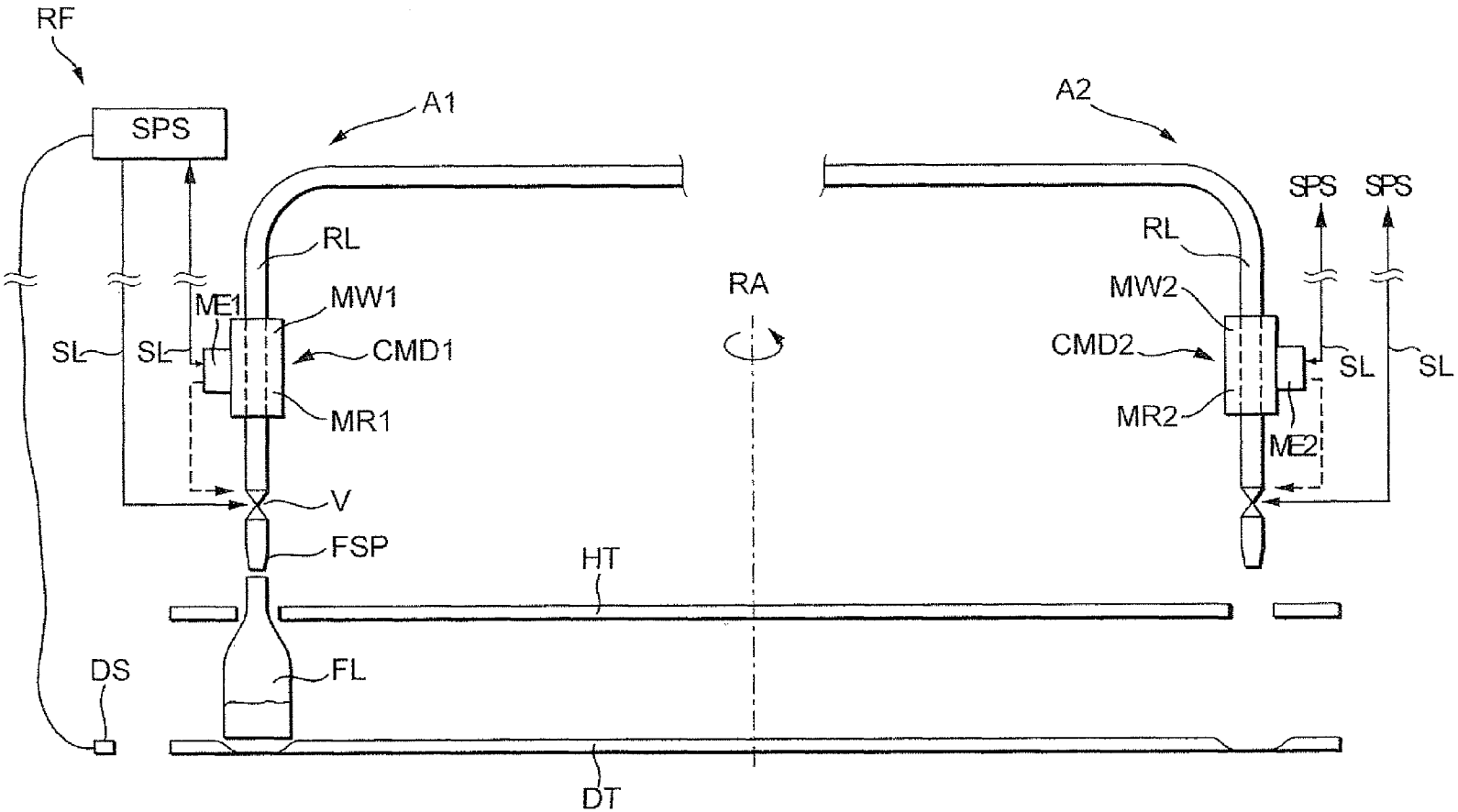
FIG. 2 a schematic, elevational view of a dispensing station of a carousel-type, filling machine as in FIG. 1.

The carousel-type filling machine includes, in the example of an embodiment shown here, 17 such dispensing stations DS1-DSn moved around the axis of rotation RA, of which FIG. 2 shows, in a schematic, elevational view, a representative first dispensing station DS1 with a first measuring transducer MT1 of the carousel-type filling machine and, located below such, a containment BL momentarily to be filled, as well as a second dispensing station DS2 with a second measuring transducer MT2 (essentially structurally and functionally equal to the first measuring transducer) of the carousel-type filling machine; however, there is no containment at station DS2. In the case of the situation shown in FIG. 2, the measuring transducer MT1 associated with the first dispensing station DS1 is in a measuring phase, which reoccurs essentially periodically, as a function of the operation. During the measuring phase, medium to be dosed, and, thus, to be measured, flows through the measuring transducer MT1. In contrast, measuring transducer MT2 associated with the second dispensing station DS2 is in a ready phase, which likewise reoccurs essentially periodically, as a function of the operation. However, in the ready phase, medium to be dosed and, thus, measured does not flow through the measuring transducer.

As additionally evident from FIG. 2, each of the dispensing stations of the carousel-type filling machine includes, besides a measuring transducer, through which medium flows, at times, during operation, additionally, a valve V arranged on the outlet side of the measuring transducer, as well as a filling tip FTP connected to the valve. Developing the typical measuring transducer MT1 further, it includes at least one measuring tube T1 inserted into the course of the pipeline and extending between an inlet of the measuring transducer for inflowing medium and an outlet of the measuring transducer for outflowing medium. During operation of the carousel-type filling machine RF, measuring tube T1 is moved around the axis of rotation RA. In the illustrated case, the measuring tube T1 is moved in a circular orbit, predominantly with an angular velocity held essentially constant. For process reasons, the medium to be measured is allowed to flow only at times through the measuring tube.

Alternatively to, or in supplementation of, the valve V shown in FIG. 2 serving as outlet-valve, also a valve serving as inlet-valve can be provided, in each case, in the dispensing stations, arranged on the inlet side of the measuring transducer, for example, for enabling also an emptying of the measuring transducer outside of its measuring phase and, thus, during its ready phase. Instead of an accompanying replacement of the medium with air, it can be of advantage, for example, for purposes of sterilization of the measuring tube, during the ready phase of the measuring transducer, to fill its at least one measuring tube temporarily with $CO_2$, nitrogen or some other inert gas.

As schematically illustrated in FIG. 2, the containment BL to be filled is held under its filling tip FTP during the filling phase of the pertinent dispensing station DS1. The containment BL is, in such case, conveyed on a rotary table RT of the carousel K and can, in case necessary, all-the-while be held by an additional holder HDR holding, for example, a possibly present, bottle neck. The current fill-level in the containment BL is indicated by a wavy line. The medium to be filled into the containment BL is supplied via the pipeline PL from a reservoir (not shown).

The at least one measuring tube T1 of the measuring transducer MT1 is additionally accommodated in a protective measuring transducer housing of the measuring transducer and can itself be at least sectionally essentially straight and/or at least sectionally curved. On the inlet side, the at least one measuring tube (and, as a result, the associated measuring transducer MT) is connected via a medium supplying line segment PL of a pipeline system with a reservoir, such as a tank, (not shown), storing the medium in suitable manner. If desired, the mentioned inlet valve is interposed in the segment PL. In the example of an embodiment shown here, provided additionally on the outlet side is a further line segment implementing the connection of outlet valve V and filling tip FTP. The connecting of the measuring transducer to the line segments can be accomplished in conventional manner via corresponding inlet- and outlet-side, especially standardized, connection elements, such as appropriate screwed connections or flanges.

In the case of the example of an embodiment shown in FIG. 2, the measuring transducers—here, representatively, the first measuring transducer MT1 and the second measuring transducer MT2—are additionally so placed in their respective dispensing stations, that the axis of rotation RA, around which the dispensing stations are guided—here circular orbiting and predominantly with an angular velocity held essentially constant—extends essentially parallel to a longitudinal axis of a particular measuring transducer connecting the inlet and the outlet of the measuring transducer or its associated connection elements. Alternatively thereto, the measuring transducer can, in case necessary, also be so arranged within the carousel-type filling machine RF, that the flow axis extending between the connection elements of each of the measuring transducers and the axis of rotation the carousel-type filling machine forms an angle of less than 90°.

The measuring transducer MT1 is, additionally, electrically connected to at least a first measuring transducer electronics ME1 serving for operating the measuring transducer, as well as also for producing measured values representing, especially digitally, the at least one measured variable. Accordingly, in the case of the situation shown in FIG. 2, the amount of medium momentarily already filled or still to be filled into the containment BL can be ascertained directly on-site by means of the measuring transducer electronics ME1 connected to the measuring transducer MT1 momentarily residing in the measuring phase.

The measuring transducer electronics ME1 and the measuring transducer MT1, especially as supplied with external electrical energy, can—such as schematically illustrated in FIG. 2 and quite usual for such dispensing stations—be united to a self-sufficient measuring system CDM1, for example, formed as an in-line measuring device in compact construction, in the case of which the measuring transducer electronics ME1 is accommodated in an electronics-housing suitably affixed externally on the measuring transducer, for example, on its, as conditions require, existing measuring-transducer housing. For holding of the electronics-housing on the measuring transducer housing, there can be provided, for example, a corresponding connection nozzle with therein inserted cable feed-through for the connecting lines serving for electrical connection of the measuring transducer electronics to the measuring transducer. In an advantageous embodiment of the invention, the measuring transducer electronics MT1 is, additionally, so designed, that it is connected to a fieldbus system and, thus, linked into a superordinated electronic data transmission and data processing system, for example, a programmable logic control or a plant-spanning, process control system PCS controlling the carousel-type filling machine. Used for this, can be standard interfaces correspondingly established, for example, in industrial measurements- and automation-technology, such as, for instance, PROFIBUS, FOUNDATION FIELDBUS, CAN-BUS, MODBUS, etc. . . . Moreover, if conditions require, also an external energy supply serving to supply the measuring transducer electronics can be connected to the fieldbus system, in order to supply the measuring system with energy, in manner known to those skilled in the art, directly, especially also exclusively, via a fieldbus system.

In the case of the example of an embodiment shown in FIG. 2, additionally, connected to the second measuring transducer MT2 for the purpose of forming an additional self-sufficient measuring system CMD2 is a corresponding second measuring transducer electronics ME2 essentially structurally and functionally equal to the first measuring transducer electronics ME1.

For the case shown here, in which, for practical purposes, each of the measuring transducers in the individual dispensing stations includes an associated measuring transducer electronics (here, also, in each case, accommodated in a separate electronics-housing), according to an embodiment of the invention, it is additionally provided, that at least two of the measuring transducer electronics communicate with one another during operation—wirelessly per radio and/or hard-wired. For example, the measuring transducer electronics of two measuring transducers operated, momentarily, in each case, in a ready phase can transmit or receive internally stored, measured values and/or corresponding internal correction values for the primary signals to be produced by means of the measuring transducer.

The carousel-type filling machine RF, especially also the RPM, with which the dispensing stations are moved around the axis of rotation RA, and/or the respective start times, at which the individual filling phases of the dispensing stations are begun, and, associated therewith, also the respective start times, at which the measuring phases of the, in each case, associated measuring transducer are begun, are all, in an embodiment of the invention, controlled and/or monitored with the assistance of a measured-values-processing, superordinated control electronics embodied, for example, in the form of a programmable logic controller PLC. The, for example, modularly embodied, control electronics can be arranged, at least partially, both on the carousel K as well as also externally of the same. For the purpose of control and/or monitoring of the individual dispensing stations, the control electronics is advantageously also electrically connected with the respective measuring transducer electronics of the dispensing stations via appropriate signal lines SL, if conditions require, also with interposing of appropriate slip-ring contacts. Alternatively thereto, or in supplementation thereof, the control electronics and measuring transducer electronics can also communicate with one another wirelessly per radio. Additionally, for a fast and precise control of the filling procedures, it can, however, also be of advantage to have the measuring transducer electronics also send control commands—wirelessly per radio and/or hardwired—directly to the at least one valve of the, in each case, associated dispensing station. For improving the accuracy, as well as also the dynamics of the control of the carousel-type, filling machines, the control electronics, in an additional embodiment of the invention, is connected with a rotational speed sensor RS, which, in the shown example of an embodiment, is arranged on the edge of the rotary table RT, and registers the rotational movement of the carousel K, for example, optically or inductively, and reoccurringly generates, and provides to the control electronics, an RPM value, especially a digital RPM value, representing a currently measured RPM of the carousel.

Applied as measuring transducer MT can be, as quite usual in the case of such carousel filling machines, a magneto-inductive flow transducer or however also a measuring transducer of vibration-type, especially a Coriolis, mass flow transducer, with a single measuring tube vibrating during operation or with two measuring tubes vibrating during operation. Construction and operation of magneto-inductive measuring transducers, as well as also measuring transducers of vibration-type are sufficiently known to those skilled in the art, so that such need not be explored further in greater detail. Furthermore, magneto-inductive measuring transducers are described at length in, among others, the initially mentioned EP-A 1 039 269, U.S. Pat. No. 6,031,740, U.S. Pat. No. 5,540,103, U.S. Pat. No. 5,351,554, and U.S. Pat. No. 4,563,904, and measuring transducer of vibration-type in among others, the initially mentioned WO-A 03/095950, WO-A 03/095949, WO-A 02/37063, WO-A 01/33174, WO-A 00/57141, WO-A 99/39164, WO-A 98/07009, WO-A 95/16897, WO-A 88/03261, US-A 2005/0139015, US 2003/0208325, U.S. Pat. No. 7,181,982, U.S. Pat. No. 7,040,181, U.S. Pat. No. 6,910,366, U.S. Pat. No. 6,895,826, U.S. Pat. No. 6,880,410, U.S. Pat. No. 6,691,583, U.S. Pat. No. 6,651,513, U.S. Pat. No. 6,513,393, U.S. Pat. No. 6,505,519, U.S. Pat. No. 6,041,665, U.S. Pat. No. 6,006,609, U.S. Pat. No. 5,869,770, U.S. Pat. No. 5,861,561, U.S. Pat. No. 5,796,011, U.S. Pat. No. 5,616,868, U.S. Pat. No. 5,602,346, U.S. Pat. No. 5,602,345, U.S. Pat. No. 5,531,126, U.S. Pat. No. 5,359,881, U.S. Pat. No. 5,301,557, U.S. Pat. No. 5,253,533, U.S. Pat. No. 5,218,873, U.S. Pat. No. 5,069,074, U.S. Pat. No. 4,957,005, U.S. Pat. No. 4,895,031, U.S. Pat. No. 4,876,898, U.S. Pat. No. 4,733,569, U.S. Pat. No. 4,660,421, U.S. Pat. No. 4,491,025 and U.S. Pat. No. 4,187,721.

During operation, each of the measuring transducers, especially measuring transducers essentially structurally and functionally equally formed, be each, now, of vibration-type or of magneto-inductive type, produces, at least at times, one primary signal, or two or more primary signals, s1, s2, for example, in the form of, as regards amplitude and/or frequency, variable voltages, which correspond to at least one physical, measured variable suited for control of the filling process, for example, a flow velocity, a mass flow m, a volume flow v and, if conditions require, also to a density ρ and/or a viscosity η, of the medium located in the measuring tube, and which are converted by the respective measuring transducer electronics, especially during the filling phase of the associated dispensing station, into the corresponding measured values.

Serving for producing the at least one primary signal is a sensor arrangement of the measuring transducer arranged on the measuring tube and/or in its vicinity. The sensor arrangement reacts to changes of the at least one physical, measured variable in a manner appropriately influencing the at least one primary signal, wherein the changes are induced by means of an exciter mechanism arranged on the measuring tube and/or in its vicinity. Depending on applied measuring transducer type, the exciter mechanism of the measuring transducer may be, for example, an electro-mechanical or an electro-magnetic, exciter mechanism. For the aforementioned case, in which the respective measuring transducer is a measuring transducer of magneto-inductive type, a magnetic field is caused, in manner known to those skilled in the art, to pass, at least at times, through the at least one measuring tube for producing voltage measurement signals serving as primary signals, and voltages induced in the medium are tapped, in manner known to those skilled in the art, by means of at least two electrodes coupled, for example, galvanically and/or capacitively with the medium. For the other of the aforementioned cases, where measuring transducers of vibration-type are applied, the primary signals are, as is known, oscillation measurement signals, which represent inlet-side or outlet-side oscillations of the at least one measuring tube of the respective measuring transducer. The measuring tube is caused to vibrate, at least at times, during operation. As a result of mass flow dependent, Coriolis forces in the flowing medium, the inlet-side and outlet-side oscillations are correspondingly phase-shifted relative to one another.

Under application of the at least one primary signal delivered, at least at times, by the associated measuring transducer, the measuring transducer electronics—if conditions require, also in cooperation with at least one of the other measuring transducer electronics and/or in cooperation with the control electronics—updates, during operation, reoccurringly, the measured value $X_M$ required for the dosing of the predetermined amount of filling into the containment located currently in the dispensing station. Examples of the measured value $X_M$ include: A flow rate in the measuring transducer, through which medium to be measured is momentarily flowing, or based on flow rate, an integrated flow, which, lastly, represents the amount so far actually dispensed into the containment, or, if conditions require, also a density of the medium.

The control electronics starts the filling procedure at each of the filling stations by opening the relevant valve and defines, thus, the beginning of the filling phase of the dispensing stations and, insofar, also the starting time of the measuring phases or the stopping time of the ready phases of the individual measuring transducers. During the filling phase of the dispensing station and the therewith corresponding measuring phase of the associated measuring transducer, the measuring transducer electronics ascertain—if conditions require, in turn, in cooperation with at least one of the other measuring transducer electronics and/or the connected control electronics—based on the at least one updated measured value $X_M$, a stopping time corresponding with the reaching of the predetermined amount of filling for the containment BL momentarily located in the dispensing station, defining the end of the current filling phase of the dispensing station and, associated therewith, also the end of the current measuring phase of the associated measuring transducer. The corresponding stop command or the therewith corresponding close signal for the valve V, which, lastly, again, prevents the medium to be measured from flowing through the at least one measuring transducer measuring tube, can, for example, be fed directly from the measuring transducer electronics ME1 per switched output to the valve V. Alternatively thereto, or, for reasons of safety, in supplementation thereof, the close signal for the valve V can be directly transmitted from the control electronics via signal line SL to the valve V; compare, in this connection, for example, also the initially mentioned WO-A 04/049641.

According to the invention, it is additionally provided, that the measuring transducer electronics ascertains the current measured value $X_M$ not only based on the at least one primary signal (referred to herein as primary signal of first class) delivered by the measuring transducer during the measuring phase, but, instead, additionally also based on at least one primary signal (referred to herein as primary signal of second class), which is generated during a reoccurring, ready phase by a measuring transducer installed on the carousel-type filling machine and, thus, likewise orbiting around the axis of rotation RA. On the basis of these considerations, the primary signal of second class thus utilized likewise for ascertaining the respective measured value $X_M$ corresponds, according to the invention, to a primary signal, which is generated by means of a measuring transducer, indeed, likewise moved around the axis of rotation, whose at least one measuring tube, at times of generating said primary signal of second class, does not, however, have medium flowing through it. Serving as primary signal of first class for the case, in which the measuring transducers, such as already mentioned, are, in each case, embodied as measuring transducers of vibration-type, is, in each case, one or a plurality of oscillation measurement signals, of which each registers vibrations, especially inlet- and outlet-side vibrations, of the at least one measuring tube, through which medium to be measured is momentarily flowing—thus in the respective measuring phase of the associated measuring transducer. In accordance with this, serving as primary signal of second class is, for example, such oscillation measurement signals, which represent, in each case, vibrations, especially inlet- and outlet-side vibrations, of at least one measuring tube orbiting around the axis of rotation of the carousel-type filling machine and not containing medium flowing through it, thus, for example, for the situation shown in FIG. 2, also the measuring transducer MT1 in a ready phase preceding its momentary measuring phase.

Additionally, it is provided that, based on the primary signal of second class, a correction value $X_K$ is ascertained for the primary signal of first class. The correction value $X_K$ can be, for example, so ascertained that, based on the primary signal of second class, according to the same measuring method, such as has been used before for preliminary measured values $X'_M$ generated in conventional manner only based on primary signals of first class—thus without taking into consideration the influences on the primary signals of first class accompanying the rotational movement of the carousel-type filling machine and/or changes of its RPM—, a corresponding auxiliary measured value $X'_K$ is ascertained. The auxiliary measured value $X'_K$, which is thus of practically the same type as the preliminary measured value $X'_M$, corresponds then to the error portion to be corrected, which is contained in the primary signal of first class as a result of the rotational movement of the carousel-type filling machine and the therewith accompanying movement of the respective measuring transducer. As a result, the auxiliary measured value $X'_K$ represents also a momentary shifting of the zero-point of the measuring system formed by means of the corresponding measuring transducer and the associated measuring transducer electronics, relative to an initial zero-point, ascertained, for example, in a corresponding calibrating of the measuring system with known medium under reference conditions.

For the mentioned case, in which the measured value $X_M$ represents an instantaneous or, if conditions require, also an average, flow rate, for example, thus a mass flow rate or a volume flow rate, the auxiliary measured value $X'_K$ corresponds essentially, thus, to a measured instantaneous or average flow rate, which represents medium seemingly flowing in the ready phase through the measuring transducer. The apparent flow represented by the auxiliary measured value $X'_K$ can, in such case, be brought about, for example, as a result of changes of RPM and therewith accompanying accelerations or deviations of the RPM from a corresponding default value and/or as a result of gas bubbles rising within the medium guided in the measuring tube. Through a simple sign change, the auxiliary measured value $X'_K$ can very simply be converted into the corresponding correction value $X_K$ and, in the case of ascertaining the actual measured value $X_M$, be appropriately taken into consideration, for example, by sign-correct addition to a preliminary measured value generated first alone by means of the primary signal of first class. Accordingly, the measured value can be ascertained in simple manner according to the following relationship:

$$X_M=(1+X_K)\cdot X'_M=(1-X'_K)\cdot X'_M$$

The measuring transducer delivering the primary signal of second class can be, for example, the second measuring transducer MT2 shown in FIG. 2 and/or, for example, also the measuring transducer, which instantaneously delivers the primary signal of first class for the purpose of ascertaining the current measured value for the situation shown in FIG. 2, thus the measuring transducer MT1. For the latter case, the primary signal of second class, which is, as a result, used in the ascertaining of the current measured value, as the at least one correction value ascertained based on the primary signal of second class or as an auxiliary measured value ascertained earlier than the at least one correction value for the current primary signal of first class, is correspondingly held, for example, in a digital, volatile, data memory of the respective measuring transducer electronics and/or in a digital data memory of the control electronics, and, in the ascertaining of the current measured value, is caused to enter appropriately into the result. Accordingly, it is, furthermore, additionally provided, that the measuring transducer electronics sends to the control electronics during operation, at least at times, especially reoccurringly, measured data, for example, thus a measured value ascertained in a measuring phase and/or an auxiliary measured value ascertained in a ready phase and/or a corresponding correction value for the primary signal of first class.

Especially for the case, in which the measured value to be ascertained is a flow rate, especially an instantaneous mass flow rate or an instantaneous volume flow rate, the correction value correspondingly ascertained therefor in aforementioned manner correlates very strongly with an instantaneous angular velocity, with which the at least one measuring transducer measuring tube, through which medium is flowing, is moved around the axis of rotation of the carousel-type filling machine, and, indeed, in such a manner, that the magnitude of the correction value $X_K$ increases with rising RPM. In the case of known properties of the medium, the correction value ascertained for the purpose of ascertaining of flow rates based on one or a plurality of primary signals of second class, thus, can also serve as a measure for the current RPM of the carousel-type filling machine and can also be correspondingly taken into consideration in the control electronics for RPM-control. Conversely, accordingly, also a currently set, or ascertained, angular velocity for the carousel-type filling machine, the angular velocity with which the dispensing stations and, as a result, also the at least one measuring transducer measuring tube, through which medium is flowing, are moved around the axis of rotation of the carousel-type filling machine, can be appropriately taken into consideration in the ascertaining of the measured value $X_M$; compare, in this connection, also the initially mentioned patent application PCT/EP2007/059139. Therefore, it is provided in an additional embodiment, that the measuring transducer electronics, during operation, at least at times, holds ready an, if conditions require, reoccurringly ascertained and/or updated, RPM value, which represents an, as much as possible, current angular velocity, with which the pertinent measuring transducer or its at least one measuring tube is orbiting momentarily around the axis of rotation. The, for example, a nonvolatily stored, RPM value can, in such case, also have been generated externally of the measuring transducer electronics, for example, by means of the control electronics and/or by means of the aforementioned rotational speed sensor RS. Taking this into consideration, in a further development of the invention, control data representing the RPM of the carousel K, such as a desired value set for the RPM and/or an actually measured RPM value, are transmitted, timely, as much as possible thus before beginning a measuring phase, to the measuring transducer electronics associated with the pertinent measuring transducer.

In case necessary, particular ones of the correction values $X_K$ ascertained during operation can be utilized additionally for monitoring the carousel-type filling machine, for example, such that, within the control electronics, unallowably high deviations of one or a number of such correction values $X_K$ relative to earlier correspondingly defined reference values are detected. As a result of a comparison with one or a plurality of such reference values, if conditions require, a corresponding alarm signaling, for example, a defective dispensing station, for example, as a result of a poorly closing valve, a deficient medium and/or a defective measuring system, can be generated, which, for example, is displayed onsite and/or at a remote, control station.

While the invention has been illustrated and described in detail in the drawings and forgoing description, such illustration and description is to be considered as exemplary not restrictive in character, it being understood that only exemplary embodiments have been shown and described and that all changes and modifications that come within the spirit and scope of the invention as described herein are desired to protected.

What is claimed is:

1. A method for operating a measuring device arranged on a rotating, carousel-type, filling machine and including a measuring transducer of vibration-type, through which a medium flows, at least at times, especially a measuring device serving for determining mass flow of a flowing medium and/or formed as a Coriolis, mass flow measuring device, which method comprises the steps of:

permitting flow of medium to be measured through at least one, at least momentarily vibrating, measuring tube orbiting around an axis of rotation of the carousel-type filling machine;

producing at least one oscillation measurement signal serving as a primary signal of first class and representing vibrations of the measuring tube as medium to be measured is flowing therethrough;

producing at least one oscillation measurement signal serving as a primary signal of second class and representing vibrations of at least one measuring tube, through which medium is not flowing, which is orbiting around the axis of rotation of the carousel-type filling machine, especially the measuring tube of said measuring transducer; and ascertaining at least one measured value representing a measured variable, especially a mass flow rate and/or an integrated mass flow and/or a density of the medium to be measured, based on both the primary signal of first class as well as also the primary signal of second class.

2. The method as claimed in claim 1, further comprising the step of:

ascertaining a correction value for the primary signal of first class based on the primary signal of second class, said correction value correlating with an instantaneous angular velocity, with which the at least one measuring transducer measuring tube, through which medium is flowing, is moved around the axis of rotation of the carousel-type filling machine, and/or represents an influence of the movement of the at least one measuring transducer measuring tube around the axis of rotation on primary signals delivered by the measuring transducer, especially the at least one primary signal of first class.

3. The method as claimed in claim 1, further comprising the step of:

ascertaining an angular velocity, with which the at least one measuring transducer measuring tube, through which medium is flowing, is moved around the axis of rotation of the carousel-type filling machine, said at least one measured value being ascertained taking into consideration the angular velocity.

4. The method as claimed in claim 1, wherein:

the medium to be measured is prevented, at times, from flowing through the at least one measuring transducer measuring tube, said method further comprising the step of:

using the measuring transducer, while such is vibrating, but medium to be measured is not flowing therethrough, for producing also the at least one primary signal of second class.

5. The method as claimed in claim 1, further comprising at least one of the following steps:

ascertaining a correction value for the primary signal of first class based on the primary signal of second class;

ascertaining an angular velocity, with which the at least one measuring transducer measuring tube, through which medium is flowing, is moved around the axis of rotation of the carousel-type filling machine;

filling a containment placed on an outlet side of the measuring transducer with medium allowed to flow through the at least one measuring tube;

preventing the medium to be measured, at times, from flowing through the at least one measuring transducer measuring tube; and using, for producing the at least one primary signal of second class, at least one additional measuring transducer, likewise orbiting around the axis of rotation of the carousel-type filling machine, and including at least one measuring tube momentarily vibrating, however, with medium to be measured not flowing therethrough, especially a measuring tube, which, in comparison with the measuring tube through which medium to be measured is momentarily flowing, is essentially of equal construction.

6. An apparatus, constructed as a carousel-type filling machine, which apparatus comprises:

at least a first measuring transducer, which includes at least one measuring tube, through which medium to be measured, especially at least partially, or predominantly, liquid medium, flows only at times, which is moved during operation about an axis of rotation, especially in circular orbit and/or with an angular velocity held essentially constant, and which, at least at times, delivers primary signals, which correspond to at least one measured variable of the medium guided in the at least one measuring tube; as well as at least one measuring transducer electronics for producing measured values, especially digital, measured values, wherein:

medium to be measured flows through the at least one measuring tube during a measuring phase, especially a periodically reoccurring measuring phase, of the first measuring transducer; and the at least one measuring transducer electronics ascertains, at least at times, especially reoccurringly, a measured value representing the at least one measured variable, especially a flow rate in the measuring transducer through which medium to be measured is flowing and/or an integrated flow, based both on at least one primary signal of first class delivered by the first measuring transducer during the measuring phase, as well as also based on at least one primary signal of second class, which is generated by means of a measuring tube likewise moved around the axis of rotation, but through which, at times of generating said primary signal of second class, the medium does not flow.

7. The apparatus as claimed in claim 6, wherein:

said measuring transducer electronics, based at least on the primary signal of second class, ascertains, especially reoccurringly, at least one correction value for the primary signal of first class.

8. The apparatus as claimed in claim 7, wherein:

said at least one measuring transducer electronics ascertains the correction value based also on the primary signal of first class delivered by the first measuring transducer, especially the primary signal of first class delivered instantaneously and/or during the measuring phase of the first measuring transducer; and/or wherein:

said measuring transducer electronics ascertains the measured value under application of both the primary signal of first class delivered by the first measuring transducer during its measuring phase as well as also under application of the correction value; and/or the at least one correction value is ascertained, before the measuring phase of the first measuring transducer begins; and/or the at least one measuring transducer electronics stores the at least one correction value, at least at times, especially in a volatile data memory; and/or the measuring transducer electronics holds ready during operation, at least at times, an RPM value, especially a reoccurringly ascertained and/or updated RPM value, which represents, instantaneously, an angular velocity, especially a current angular velocity, with which the at least one measuring tube orbits around the axis of rotation.

9. The apparatus as claimed in claim 7, wherein:

the at least one correction value delivered by the measuring transducer electronics corresponds to a measured flow rate, especially an instantaneous or average measured flow rate, especially a mass flow rate or a volume flow rate, which represents medium seemingly flowing through the measuring transducer in the ready phase.

10. The apparatus as claimed in claim 7, wherein:

the at least one correction value delivered by the measuring transducer electronics correlates with an instantaneous angular velocity, with which the at least one measuring tube of the first measuring transducer is moved around the axis of rotation, and/or which represents, instantaneously, an influence of the movement of the at least one measuring tube of the first measuring transducer around the axis of rotation on primary signals delivered by the measuring transducer, especially the primary signal of first class delivered during the measuring phase.

11. The apparatus as claimed in claim 6, wherein:

the first measuring transducer is connected via an inlet-side, first connection element, especially a screwed connection or a flange, to a line segment of a pipeline system for supplying medium to be measured; and/or the first measuring transducer is connected via an outlet-side, second connection element, especially a screwed connection or a flange, to a line segment of the pipeline system for removing measured medium; and/or the at least one measured value delivered by the measuring transducer electronics represents a mass flow rate, especially an instantaneous or integrated mass flow rate, of the medium actually flowing through the first measuring transducer in the measuring phase.

12. The apparatus as claimed in claim 6, wherein:

the first measuring transducer is connected via an inlet-side, first connection element, especially a screwed connection or a flange, to a line segment of a pipeline system for supplying medium to be measured, and the first measuring transducer is connected via an outlet-side, second connection element, especially a screwed connection or a flange, to a line segment of the pipeline system for removing measured medium; and the first measuring transducer shows an imaginary flow axis connecting the two connection elements.

13. The apparatus as claimed in claim 12, wherein:

the first measuring transducer is so arranged within the apparatus, that its flow axis and the axis of rotation form an angle of less than 90°, especially that the flow axis of the first measuring transducer is essentially parallel to the axis of rotation.

14. The apparatus as claimed in claim 6, wherein:

the at least one measuring tube, especially a tube segment thereof, caused to vibrate during operation, is, at least sectionally, essentially straight; and/or the at least one measuring tube, especially a tube segment thereof, caused to vibrate during operation, is, at least sectionally, curved; and/or the at least one measuring transducer electronics is arranged in the immediate vicinity of the first measuring transducer and/or is essentially rigidly connected therewith.

15. The apparatus as claimed in claim 14, wherein:

the at least one measuring transducer electronics is accommodated in an associated electronics-housing, especially in an electronics-housing mounted on the measuring transducer housing of the first measuring transducer.

16. The apparatus as claimed in claim 6, further comprising:

a control electronics for setting and monitoring an angular velocity, with which the at least one measuring tube of the first measuring transducer is moved around the axis of rotation.

17. The apparatus as claimed in claim 16, wherein:

said measuring transducer electronics and said control electronics communicate with one another, at least at times, during operation, especially wirelessly via radio; and/or said measuring transducer electronics sends to said control electronics, during operation, at least at times, especially reoccurringly, measured data, especially a measured value and/or a correction value for the primary signal of first class, and/or said measuring transducer electronics receives, during operation, at least at times, especially reoccurringly, control data generated by said control electronics, especially a current angular velocity, with which the at least one measuring tube of said first measuring transducer is moved around the axis of rotation.

18. The apparatus as claimed in claim 6, wherein:

said measuring transducer electronics stores, during operation, at least at times, an RPM value, especially an RPM value generated digitally and/or externally of said measuring transducer electronics, which represents, instantaneously, an angular velocity, with which the at least one measuring tube of said first measuring transducer is moved around the axis of rotation.

19. The apparatus as claimed in claim 18, wherein:

said measuring transducer electronics ascertains the at least one measured value, and/or the correction value for the at least one primary signal of first class, taking the RPM value into consideration.

20. The apparatus as claimed in claim 6, wherein:

said first measuring transducer also delivers the primary signal of second class.

21. The apparatus as claimed in claim 20, wherein:

said first measuring transducer generates the primary signal of second class during a ready phase, especially a periodically reoccurring ready phase, during which the medium to be measured does not flow through at least one measuring tube of the first measuring transducer; and/or said measuring transducer electronics ascertains the at least one measured value both based on the primary signal of first class delivered by said first measuring transducer during its measuring phase as well as also based on the primary signal of second class delivered by said first measuring transducer during its ready phase; and/or the correction value delivered by said measuring transducer electronics corresponds to a measured flow rate, especially an instantaneous or average flow rate, especially a mass flow rate or a volume flow rate, which represents medium seemingly flowing in the ready phase through the measuring transducer.

22. The apparatus as claimed in claim 6, wherein:

said first measuring transducer is a measuring transducer of vibration-type, in the case of which measuring transducer the at least one measuring tube is caused to vibrate, at least at times, for producing oscillation measurement signals serving as primary signals.

23. The apparatus as claimed in claim 22, wherein:

medium to be measured flows through the at least one measuring tube of the first measuring transducer during its measuring phase and the at least one measuring tube of the first measuring transducer is caused to vibrate for generating at least a first oscillation measurement signal serving as primary signal of first class representing vibrations of the at least one measuring tube; and/or the measuring tube, especially the measuring tube of said first measuring transducer, serving for generating the at least one primary signal of second class, is likewise caused to vibrate; and wherein a second oscillation measurement signal representing vibrations of said measuring tube serves as primary signal of second class; and/or said at least one measuring transducer electronics ascertains, based on the primary signal of first class delivered by said first measuring transducer during its measuring phase, as well as based on the primary signal of second class, a difference value, which represents a difference between an oscillation frequency, especially an instantaneous or average oscillation frequency, with which the at least one measuring tube of said first measuring transducer is caused to vibrate during its measuring phase, and an oscillation frequency, especially average oscillation frequency, with which the at least one measuring tube serving for generating the primary signal of second class is caused to vibrate.

24. The apparatus as claimed in claim 22, wherein:

said first measuring transducer delivers, during its measuring phase, a first primary signal of first class, which represents inlet-side vibrations of the at least one measuring tube; and, said first measuring transducer, especially concurrently with the first primary signal, delivers at least a second primary signal of first class, which represents outlet-side vibrations of the at least one measuring tube.

25. The apparatus as claimed in claim 24, wherein:

said at least one measuring transducer electronics, based on the first and second primary signals of first class delivered by said first measuring transducer during its measuring phase, ascertains a phase difference between inlet-side and outlet-side vibrations of the at least one measuring tube corresponding to a mass flow rate of the medium flowing in the at least one measuring tube.

26. The apparatus as claimed in claim 25, wherein:

said at least one measuring transducer electronics ascertains, based on the phase difference, the at least one measured value, especially a measured value representing, instantaneously, mass flow rate of medium flowing in the at least one measuring tube of said first measuring transducer.

27. The apparatus as claimed in claim 22, wherein:

the at least one measuring tube of said first measuring transducer is caused to vibrate also during the ready phase of said first measuring transducer for generating the at least one primary signal of second class.

28. The apparatus as claimed in claim 27, wherein:

said first measuring transducer delivers, during its ready phase, a first primary signal of second class, which represents inlet-side vibrations of the at least one measuring tube during the ready phase; and said first measuring transducer delivers, especially concurrently with the first primary signal of second class, at least a second primary signal of second class, which represents outlet-side vibrations of the at least one measuring tube during the ready phase.

29. The apparatus as claimed in claim 22, wherein:

said at least one measuring transducer electronics ascertains the at least one measured value based on an oscillation frequency, with which the at least one measuring tube is caused to vibrate during operation of said first measuring transducer, especially during its measuring phase, especially an instantaneous or average oscillation frequency corresponding to a density of the medium guided in the at least one measuring tube; and/or said at least one measuring transducer electronics ascertains, on the basis of the primary signal of first class, an oscillation frequency, with which the at least one measuring tube of said first measuring transducer is caused to vibrate during its measuring phase.

30. The apparatus as claimed in claim 22, wherein:

said at least one measuring transducer electronics generates the at least one measured value based on an oscillation frequency corresponding to a density of the medium guided in the at least one measuring tube, especially an instantaneous or average oscillation frequency, with which the at least one measuring tube of said first measuring transducer is caused to vibrate during its ready phase; and/or said at least one measuring transducer electronics ascertains an oscillation frequency, with which the at least one measuring tube of said first measuring transducer is caused to vibrate during its ready phase, on the basis of the primary signal of second class.

31. The apparatus as claimed in claim 6, wherein:

said first measuring transducer is a measuring transducer of magneto-inductive type, in the case of which a magnetic field passes through the at least one measuring tube of said measuring transducer, at least at times, especially during the measuring phase, for producing voltage measurement signals serving as primary signals, and voltages induced in the medium are tapped by means of at least two electrodes, especially electrodes galvanically and/or capacitively coupled to the medium.

32. The apparatus as claimed in claim 6, further comprising:

at least a second measuring transducer spaced from said first measuring transducer, especially a measuring transducer structurally and functionally equal to said first measuring transducer.

33. The apparatus as claimed in claim 32, wherein:

said second measuring transducer includes at least one measuring tube, through which, at least at times, medium does not flow, and which is likewise moved around the axis of rotation during operation;

said second measuring transducer delivers, at least at times, primary signals, which correspond to at least one measured variable of medium guided in its at least one measuring tube; and/or medium, during a ready phase, especially a periodically reoccurring ready phase, of said second measuring transducer, does not flow through the at least one measuring tube of said second measuring transducer moved around the axis of rotation; and/or the primary signal of second class is generated by said second measuring transducer during its ready phase; and/or said measuring transducer electronics ascertains the at least one measured value both based on the primary signal of first class delivered by said first measuring transducer during its measuring phase as well as also based on the primary signal of second class delivered by said second measuring transducer during its ready phase; and/or also said second measuring transducer, during a measuring phase, especially a periodically reoccurring measuring phase, in which medium to be measured flows through its measuring tube, delivers at least one primary signal of first class, which corresponds to a measured variable of the medium flowing in the associated at least one measuring tube.

34. The apparatus as claimed in claim 6, wherein:

the measuring tube of said measuring transducer, generating, during its ready phase, the primary signal of second class, is filled, at least partially, with essentially the same medium, which is allowed to flow in the at least one measuring tube of said measuring transducer generating, during its measuring phase, the primary signal of first class; and/or the at least one measuring tube of said measuring transducer, generating, during its ready phase, the primary signal of second class, is filled only partially with essentially the same medium, which is allowed to flow in the at least one measuring tube of said measuring transducer generating the primary signal of first class during its measuring phase; and/or the at least one measuring tube of said measuring transducer, generating, during its ready phase, the primary signal of second class, is at least partially filled with a medium other than that allowed to flow in the at least one measuring tube of said measuring transducer generating the primary signal of first class during its measuring phase; and/or the at least one measuring tube of said measuring transducer, generating, during its ready phase, the primary signal of second class, is filled, especially exclusively or at least predominantly, with gas, especially nitrogen or air; and/or a starting time, in the case of which the ready phase of said measuring transducer generating the primary signal of second class begins, is placed timewise before a starting time, in the case of which the measuring phase of said measuring transducer generating the primary signal of first class begins; and/or a stop time, in the case of which the ready phase of said measuring transducer generating the primary signal of second class ends, is placed timewise before a stop time, in the case of which the measuring phase of said measuring transducer generating the primary signal of first class ends.

35. The apparatus as claimed in claim 34, wherein:

the stop time, in the case of which the ready phase of said measuring transducer generating the primary signal of second class ends, is placed timewise before the starting time, in the case of which the measuring phase of said measuring transducer generating the primary signal of first class begins.

36. The apparatus as claimed in claim 6, further comprising:

at least one valve setting a flow through said at least one measuring transducer measuring tube, especially a valve arranged on the outlet side of said first measuring transducer.

37. The apparatus as claimed in claim 36, wherein:

said at least one valve is controlled by means of said at least one measuring transducer electronics, especially under application of the at least one measured value; and/or said at least one measuring transducer electronics monitors said at least one valve, especially as regards closing behavior thereof, especially under application of the at least one primary signal of second class and/or a correction value derived therefrom for the at least one primary signal of first class.

38. The apparatus as claimed in claim 6, further comprising:

a plurality of measuring transducers, especially measuring transducers structurally and functionally equal to said first measuring transducer, of which each of the plurality includes at least one measuring tube arranged spaced, especially along a shared circumference, from the at least one measuring tube of said first measuring transducer, and, likewise, in each case, moved around the axis of rotation.

39. The apparatus as claimed in claim 38, wherein:

each of said measuring transducers delivers, at least at times, primary signals, which correspond to at least one measured variable of the medium guided in said at least one associated measuring tube; and/or medium to be measured flows through the at least one measuring tube moved around the axis of rotation in the case of each of said measuring transducers during a measuring phase of the associated measuring transducer, especially a periodically reoccurring measuring phase; and/or each of said measuring transducers delivers, during its measuring phase, primary signals of first class, which correspond to at least one measured variable of the medium guided in the at least one associated measuring tube, especially such that a plurality of said measuring transducers deliver primary signals of first class concurrently; and/or each of said measuring transducers includes a measuring transducer housing, which houses the at least one measuring tube; and/or medium does not flow through the at least one measuring tube moved around the axis of rotation in the case of each of said measuring transducers during a ready phase of the associated measuring transducer, especially during a periodically reoccurring ready phase; and/or each of said measuring transducers includes, in each case, an associated measuring transducer electronics, especially a measuring transducer electronics accommodated, in each case, in a separate electronics-housing; and/or a plurality of said measuring transducers deliver, during respective ready phases, primary signals of second class, which correspond to at least one measured variable of the medium guided in the at least one associated measuring tube, especially such that a plurality of said measuring transducers deliver primary signals of second class concurrently.

40. The apparatus as claimed in claim 38, wherein:

each of said measuring transducers includes, in each case, an associated measuring transducer electronics, especially a measuring transducer electronics accommodated, in each case, in a separate electronics-housing, and at least two of said measuring transducer electronics communicate with one another during operation, especially wirelessly via radio and/or hardwired, especially for sending and/or receiving measured values and/or for sending and/or receiving correction values for primary signals produced by means of measuring transducers.

* * * * *